US006272864B1

(12) United States Patent
Keller

(10) Patent No.: US 6,272,864 B1
(45) Date of Patent: Aug. 14, 2001

(54) COMBUSTOR FOR A GAS TURBINE

(75) Inventor: Jakob J. Keller, deceased, late of Wohlen (CH), by George B. Keller, Vera E. Keller, Maria A. Keller-Schärli, Legal Representatives

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/470,964

(22) Filed: Dec. 23, 1999

(30) Foreign Application Priority Data

Dec. 29, 1998 (DE) ..... 198 60 583

(51) Int. Cl.[7] ..... F02G 3/00; F23R 3/44
(52) U.S. Cl. ..... 60/737; 60/39.17
(58) Field of Search ..... 60/737, 39.17, 60/39.36

(56) References Cited

U.S. PATENT DOCUMENTS

| | | | | |
|---|---|---|---|---|
| 3,877,219 | * | 4/1975 | Hagen | 60/39.17 X |
| 4,073,137 | * | 2/1978 | Roberts | 60/737 X |
| 4,081,957 | | 4/1978 | Cox, Jr. . | |
| 4,838,029 | | 6/1989 | Gleason et al. . | |
| 5,497,611 | * | 3/1996 | Benz et al. | 60/39.06 |
| 5,575,153 | * | 11/1996 | Ito et al. | 60/737 |
| 5,577,378 | | 11/1996 | Althaus et al. . | |
| 6,192,669 | * | 2/2001 | Keller et al. | 60/39.36 |

FOREIGN PATENT DOCUMENTS

| | | |
|---|---|---|
| 679 799 | 4/1992 | (CH) . |
| 39 42 042 | 6/1991 | (DE) . |
| 42 36 071 | 4/1994 | (DE) . |
| 669 500 | 8/1995 | (EP) . |
| 2 098 719 | 11/1982 | (GB) . |
| 62-158927 | 7/1987 | (JP) . |

* cited by examiner

*Primary Examiner*—Timothy S. Thorpe
*Assistant Examiner*—David J. Terrente
(74) *Attorney, Agent, or Firm*—Burns, Doane, Swecker & Mathis, L.L.P.

(57) ABSTRACT

A combustor system for a gas turbine is disclosed in which fuel is mixed with an air stream entering the combustor and is then burned, and the resulting combustion air stream is fed downstream from the combustor to a turbine. A quick and efficient mixing of the air stream and fuel is achieved in that the combustor has an annular diffuser into which the air stream enters. Downstream from the diffuser and communicating with it, at least one essentially annular, toroidal chamber is provided. Mixing pipes extend downstream from the annular, toroidal chamber and are distributed over the periphery of the toroidal chamber. Downstream from the mixing pipes, an annular combustion chamber is provided into which the mixing pipes merge.

15 Claims, 3 Drawing Sheets

COMBUSTOR FOR A GAS TURBINE

FIELD OF THE INVENTION

The invention relates to gas turbines; and more particularly relates to a combustor for a gas turbine, in which combustor fuel is mixed with an air stream entering the combustor and is then burned, and the resulting combustion air stream is fed downstream from the combustor to a turbine.

BACKGROUND OF THE INTENTION

Today, gas turbines are often constructed so that the air stream guided through them is passed through two combustors and accordingly is guided twice through turbines. The drawn-in air is hereby passed first through a compressor group, and then into a primary combustor where supplied fuel/air mixture is ignited and burned. The hot combustion air then flows from the primary combustor through a first turbine, and is fed downstream from the first turbine into a secondary combustor where fuel and, if necessary, more auxiliary air, is mixed in and ignites the mixture. Since the gases flowing out of the first turbine are frequently very hot, i.e., are above the self-ignition temperature of the fuels, an active ignition in the secondary combustor is in most cases not necessary. Downstream from the secondary combustor is a second turbine, through which the hot combustion gases from the secondary combustor flow.

For space reasons and for technical simplification, the individual components in such gas turbines are provided mostly in series along a main axis of the gas turbine. Such a gas turbo group is known, for example, from U.S. Pat. No. 5,577,378. The individual channels for the air streams and combustors all are hereby designed in most cases essentially in the form of hollow cylinders extending around the axis of the gas turbine.

Secondary combustors for such gas turbines are, as a rule, designed in a relatively simple manner since they do not need burners, but the fuel can be simply injected into the air stream via nozzles following a suitable swirling of the hot air exiting the first turbine, and the mixture self-ignites after a characteristic time. A simple, hollow-cylindrically designed secondary combustor is known, for example, from U.S. Pat. No. 5,497,611.

Because of the high mach values in secondary combustors that are necessary, for example, among other things, because of the short self-ignition times especially of gaseous fuels, thermoacoustic oscillations with high amplitudes frequently occur in the secondary combustors. In addition, there is the problem of a quick and effective mixing of air and fuel in the combustion chamber while at the same time preventing a backflow. In most cases, specific swirl-generating elements are provided for this purpose. In addition, it must be ensured during the mixing and during the combustion control, especially in more recent times, that the emission values remain within the legally permissible limits.

SUMMARY OF THE INVENTION

It is therefore the objective of the invention to create a combustor for gas turbines that prevents the disadvantages of the known solutions and is characterized in particular by a good and efficient mixing of fuel and the added air.

In a combustor of the initially mentioned type, this objective is realized in that the combustor has an annular diffuser into which enters the air stream; that downstream from the diffuser, and communicating with it, at least one essentially annular, toroidal chamber is provided; that downstream from the annular, toroidal chamber and distributed over its periphery mixing pipes branch off, and that downstream from the mixing pipes an annular combustion chamber is provided into which merge the mixing pipes. The core of the invention is that the combination of diffuser, annular toroidal chamber and mixing pipes provide a premixing structure in which the air flowing through can be mixed optimally, i.e., quickly and efficiently, with fuel. Another advantage is that with the suggested configuration there is less of a tendency of thermoacoustic oscillations.

A first preferred embodiment of the combustor according to the invention is characterized in that the combustor is designed as a secondary combustor, and that the gas turbine has a primary combustor, a first turbine acting downstream from the primary combustor, a secondary combustor acting downstream from the first turbine, and a second turbine acting downstream from the secondary combustor. The use of the combustor as a secondary combustor is advantageous since especially this type of use at high mach values requires short mixing times. The quick and backflow-free mixing in the suggested arrangement is advantageous especially if the ignition, as described in another embodiment, takes place in the secondary combustor by self-ignition, and this makes it possible to ensure a controlled combustion in the area of the outlet of the mixing pipes into the combustor or inside the combustor.

Another preferred embodiment of the combustor according to the invention is characterized in that the diffuser is designed in such a way that the air stream flowing parallel to the gas turbine axis and entering the combustor is first deflected essentially in radial direction, and that the diffuser acts on the annular toroidal chamber tangentially so that the air stream entering the annular toroidal chamber coils in a torus and swirls around the annular secondary torus axis. If now, in addition, the mixing pipes are preferably provided on the side essentially opposing the diffuser in a manner essentially parallel to the axis of the gas turbine, two swirls with different rotating direction will then collide with each other before the mixing pipes and will then flow through the mixing pipes while mixing with each other and destroying the swirls. This makes it possible, as described in another embodiment, to provide means in or in front of the area of this mixing of the counter-rotating swirls which can be used to inject fuel into the air stream. This makes it possible to keep the mixing process short and adjust the ignition front to the desired location.

BRIEF DESCRIPTION OF THE DRAWINGS

Preferred embodiment of the inventions are illustrated in the accompanying drawings in which.

WAYS OF REALIZING THE INVENTION

The suggested design of the combustor is based, among other things, on the spectacular combination and mixing behavior of colliding, subcritical swirls that rotate in opposite directions. This phenomenon was discovered in the flow behavior in front of and inside radial outlet pipes of steam turbines. In these, it was found that the outflow of the rotating air with the least losses is only possible if radial outlet pipes are provided, whereas simple openings create losses as a result of swirling. A detailed observation of the behavior of the air stream in front of and inside such a radial outlet pipe shows that two each subcritical swirls that rotate in a screw-type fashion in opposite directions collide in each case before the pipes, and that the rotations of the two swirls completely compensate each other within a distance of less than one diameter of the outlet pipe.

While in combustors and in particular in secondary combustors, according to the state of the art, usually swirl-generating elements, such as swirling baffles or interference air inlets must be provided in order to ensure a quick and effective mixing of air and fuel, the mixing in the suggested combustor is based on a structuring and guidance of the flow channels that inherently results in a controlled swirling and mixing of the air flowing through them.

Figure 1:
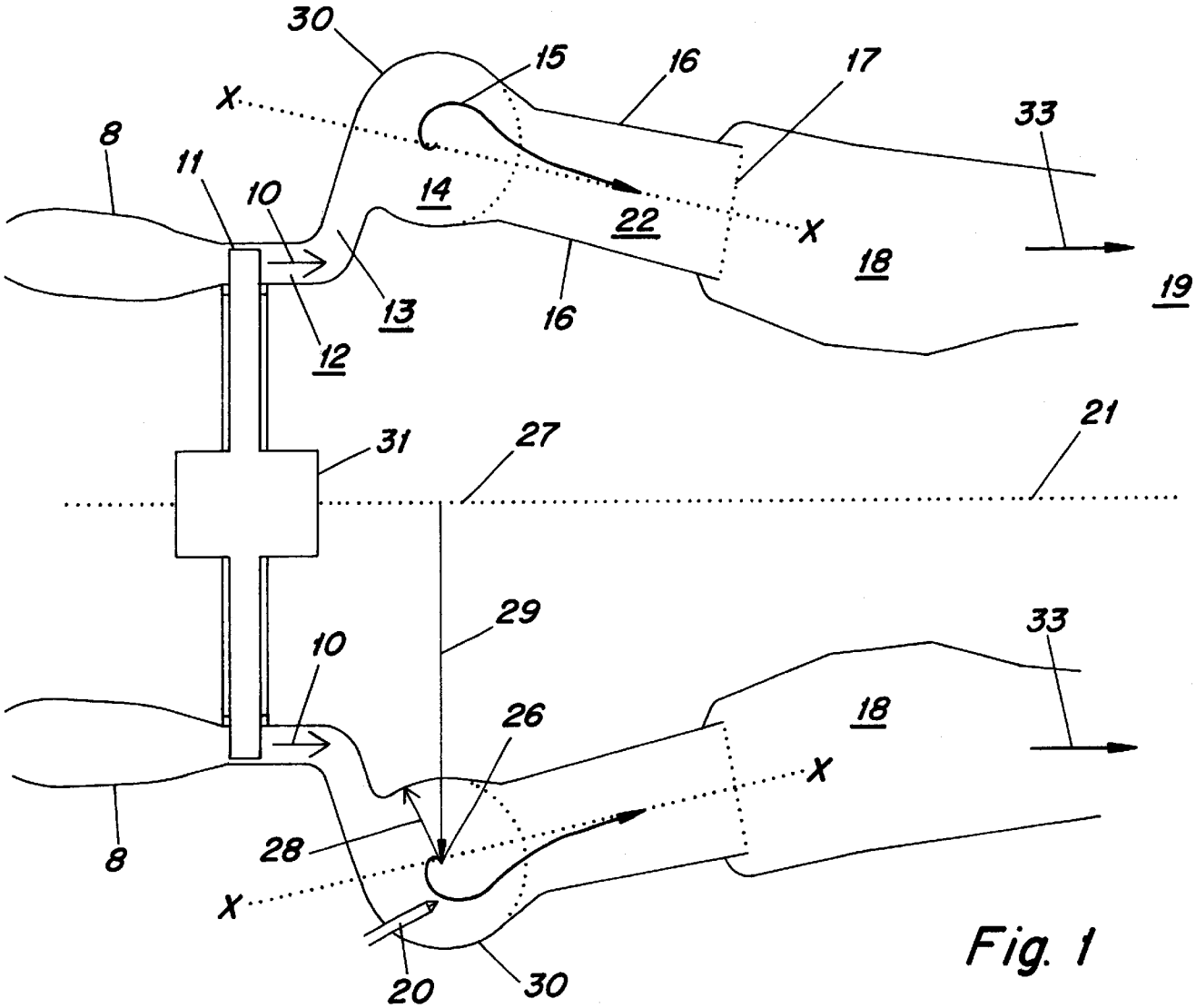
FIG. 1 shows an axial longitudinal section through a part of a gas turbine with secondary combustor.

The new concept is shown schematically in FIG. 1 in reference to a secondary combustor. FIG. 1 shows a longitudinal section along axis 21 of a gas turbine. In essence, the entire three-dimensional combustor structure is hereby obtained by rotating the section around axis 21, i.e., the channeling components, except for the mixing pipes 22, are axially symmetrical parts around the axis 21 of the gas turbine. In the shown gas turbine, the hot air stream exiting the first combustor 8, i.e., the primary combustor, flows first over a first turbine 11 positioned in a bearing 31. Downstream from the first turbine 11 is a short, hollow-cylindrical outflow line 12 through which the air stream from the first turbine 10 flows parallel to the axis 21 of the gas turbine. It is preferred that the outflow line 12 is hereby just long enough that the axial, hollow-cylindrical flow profile in the air stream 10 is able to recover. Downstream from the outflow line 12 is a diffuser 13 in which the air stream is deflected in a controlled manner from the axial direction.

The deflection in FIG. 1 hereby takes place outward in an almost radial direction; but in principle it would also be conceivable that the deflection could take place inward. The curvature of the diffuser 13 can be optimized using the inverse Euler equations. The object of the diffuser 13 is essentially to approximately halve the mean flow speed of the air stream.

Downstream, the diffuser 13 tangentially abuts an annular, toroidal chamber 14. The torus 14 is provided vertically to the axis 21 of the generator, with a large torus radius 29 around the axis 21, i.e., the main torus axis 27 and the axis 21 of the generator coincide. The circular line of the large torus radius 29 forms the annular secondary torus axis 26, and the torus outside wall 30 is formed by a small torus radius 28 around the annular secondary torus axis 26. As a result of the tangential inflow of the air stream from the diffuser 13 into the annular, toroidal chamber 14, the air stream is deflected in a controlled manner around the annular secondary torus axis 26 and coils inward in the form of a torus, as is shown in the first section of the trajectory 15 of the swirl center in FIG. 1.

Downstream from the annular, toroidal chamber 14 is a number of mixing pipes 22 that branch off the chamber 14 vertically to the annular secondary torus axis 26 and are distributed over the periphery of the chamber 14. The air stream coiled in the torus 14 flows from the annular toroidal chamber 14 through these mixing pipes 22. The mixing pipes 22 are constructed cylindrically or at least partially conically and preferably have a radius in the range of the small torus radius 28. Downstream from the mixing pipes 22, the actual combustion chamber 18 is located which is again designed essentially as a hollow cylinder around the axis 21, and downstream from this combustion chamber 18 a second turbine is provided.

Figure 2:
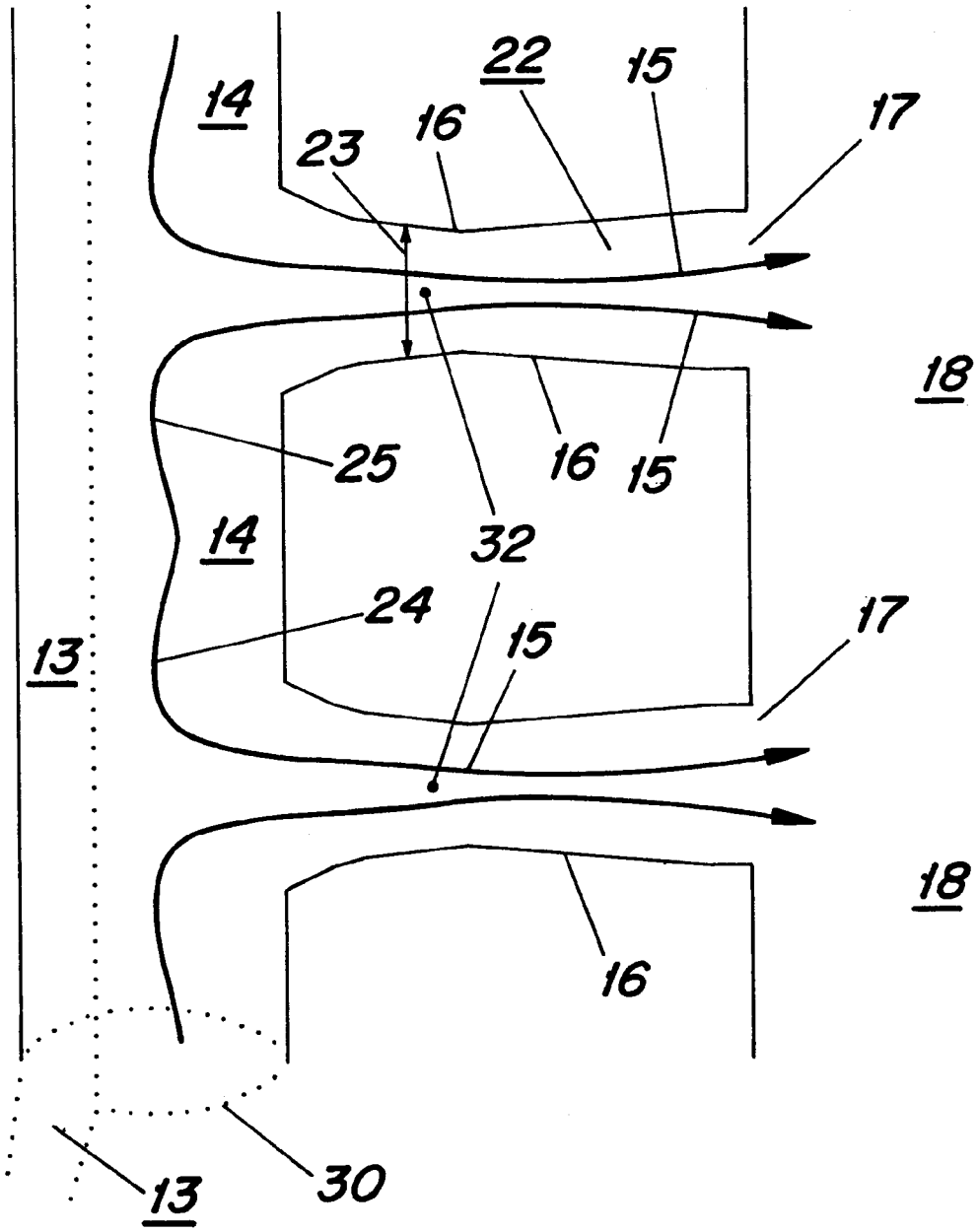
FIG. 2 shows a partial view of a section along the conus plane X—X from FIG. 1 in a view from the outside to the inside; and, FIG. 3 shows the swirl number as a function of the small radius of the torus in meters.

FIG. 2 shows a part of a conical section through the chamber 14 and the mixing pipes 22 along the plane X—X in FIG. 1 in a view from the outside to the inside. The behavior of the air stream in the chamber 14 and the mixing pipes 22 can be illustrated with the help of this section. If, for reasons of simplicity, the air stream is observed that enters the chamber 14 tangentially from the diffuser 13, exactly in the middle between two mixing pipes 22, this air stream splits into two swirls 24 and 25 that are deflected to the left and to the right and rotate in opposite helical directions; 24 hereby corresponds to a left-rotating helix, 25 to a right-rotating helix. Each of the partial swirls 24 and 25 now rotates helically in the direction of the closest mixing pipe 22 in order to then be able to flow out from the chamber 14 there. If the geometrical dimensions are measured correctly, the flow is only inverted, if at all, in the areas of the annular toroidal chamber 14 upstream from the mixing pipes 22. Now two swirls, each of which has a different sense of helical rotation, collide with each other immediately in front of the mixing pipes. As soon as the two swirl centers enter into the mixing pipes 22, any flow inversion will stop, and jet-like swirl centers will form. At a specific point in the area of the inlet of the mixing pipes, the counter-rotating swirls approximate each other maximally, and the intensive combination process of the two swirls will start exactly in this area, whereby the swirling is completely compensated. This complete compensation usually takes place within a distance of less than one diameter of the mixing pipes 22 and results in the complete mixing of the two air streams.

It is advantageous that especially in the area where the two swirls approach each other maximally, nozzles 32 are provided with which liquid or gaseous fuel can be injected. In this way, an optimum mixing of fuel and air is achieved under safe conditions. Liquid fuel also can be injected into the air stream through nozzles 20 located on the wall sides of the annular toroidal chamber 14 that are located opposite from the mixing pipes 22: depending on the site of the injection, the self-ignition characteristics of the injected fuel, the temperature of the air stream, and the flow speed, the self-ignition of the mixture causes, as a result of the high air temperature, a flame front which then may be located either in the area of the outlet of the mixing pipes 22 or behind them in the combustion chamber 18.

In order to be able to specifically optimize the dimensions of the individual components, it is advantageous to compare the swirl number changes of the concept at hand with those of such designs for which experimental data do exist. The swirl number relevant for the collision of subcritical swirls can be found as follows. To obtain the volume flow, it is necessary that the following applies:

$$A_l u_l = A_g u_g,$$

whereby $A_l$ and $A_g$ are the cross-section areas of the tangential input of the diffuser 13 into the annular toroidal chamber 14 and the cross-section area 23 of the mixing pipes 22, and $u_l$ and $u_g$ are the corresponding flow speeds. With the help of the eccentricity radius $r_i$ of the tangential inlet and the effective speed component $w_E$ of the swirl at the outlet, the condition for obtaining the rotation impulse can be expressed as follows:

$$r_l u_l = \sqrt{\frac{A_E}{\pi}}\, w_E.$$

Accordingly, the swirl number $\xi$ of the colliding swirls can be expressed as $$\xi = \frac{w_E}{u_E} = \frac{r_l\sqrt{A_E \pi}}{A_l}.$$

TABLE 1

| Value | Unit | Value |
|---|---|---|
| Mass flux | kg/s | 450.4 |
| Density | $kg/m^3$ | 3.81 |
| # of mixing pipes | | 12 |
| Outlet speed | m/s | 140 |
| Large torus radius | m | 1.4 |
| Small torus radius | m | 0.15 |
| Width of inlet slit | m | 0.12 |
| Volume flux | $m^3/s$ | 118.215 |
| Diameter of mixing pipes at outlet | m | 0.2993 |
| Total outlet area | $m^2$ | 0.8444 |
| Radius of tangential inlet | m | 1.25 |
| Total area of inlet slit | $m^2$ | 0.9425 |
| Flow speed at outlet slit | m/s | 125.43 |
| Area of inlet slit per swirl arm, $A_i$ | $m^2$ | 0.03927 |
| Eccentricity radius, $r_i$ | m | 0.09 |
| Cross-section area of swirl arm, $A_g$ | $m^2$ | 0.07069 |
| Swirl number | | 1.08 |

Table 1 lists the values for a secondary combustor with twelve mixing pipes 22, each of which has an outlet radius of 300 mm. The large radius of the outlet of the mixing pipes 22 that are distributed in a circular fashion around the axis 21 via the chamber 14 is hereby 1161 mm, which results in a peripheral distance of the mixing pipes of slightly more than twice the diameter of a mixing pipe.

TABLE 2

| Value | Unit | Value 1 | Value 2 |
|---|---|---|---|
| Large torus radius | m | 0.0675 | 0.0675 |
| Small torus radius | m | 0.0275 | 0.0275 |
| Width of inlet slit | m | 0.0085 | 0.0135 |
| Radius of tangential inlet | m | 0.04425 | 0.04675 |
| Area of inlet slit per swirl arm, $A_i$ | $m^2$ | 0.01182 | 0.001983 |
| Eccentricity radius, $r_i$ | m | 0.02325 | 0.02075 |
| Cross-section area of swirl arm, $A_g$ | $m^2$ | 0.002376 | 0.002376 |
| Swirl number | | 1.70 | 0.90 |

If the swirl number value in Table 1 of 1.08 is compared to the experimental values for the outlets of steam turbines in Table 2, it can be seen that in the latter case swirl numbers of 0.9 to 1.7 occur. In the case of a "twin combustor" of the applicant with an area of the inlet slit for each swirl arm, $A_i$, of 0.010278 $m^2$, an eccentricity radius, $r_i$ of 0.04375 m, and a cross-section area of the swirl arm, $A_g$, of 0.047144 $m^2$, a high swirl number of $\xi$=1.64 exists.

Figure 3:
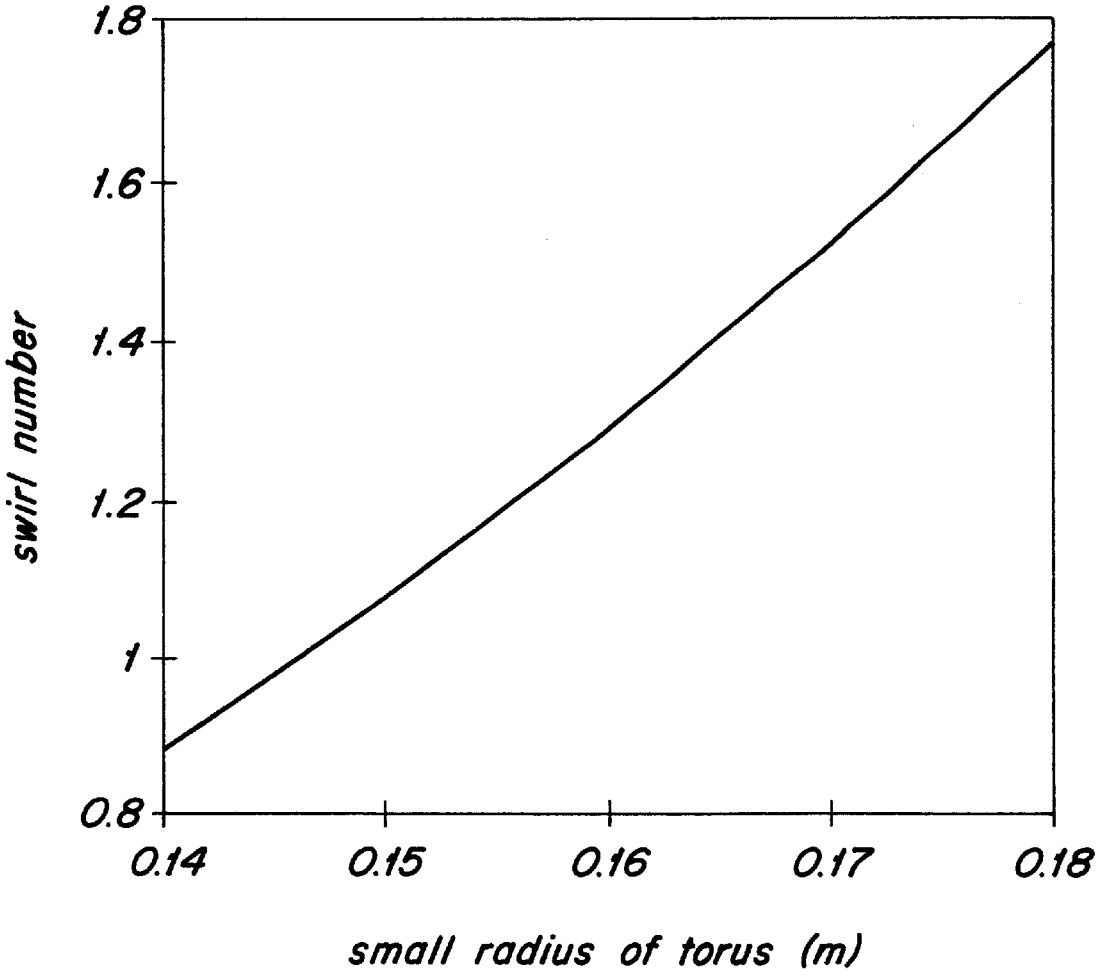

In order to obtain an optimum compromise between quick mixing and relatively unimportant domains of flow inversion upstream from the swirl center, the swirl number $\xi$ should be near 1. The best strategy probably would be the variation of the small torus radius 28 upstream from the mixing pipes 22, for which purpose a starting value of 150 mm could be used initially. FIG. 3 shows the swirl number as a function of the small torus radius 28 in meters, whereby all other values are kept the same as in Table 1. It can be seen that the swirl number can be greatly varied by varying the small torus radius 28; experience has shown that the small torus radius 28 optimally should not greatly deviate from the typical mixing pipe radius.

What is claimed is:

1. A combustor arrangement for a gas turbine comprising: an annular diffuser, conduit means for conducting an air stream into the annular diffuser, at least one annular toroidal chamber, the annular diffuser communicating with the toroidal chamber, a plurality of mixing pipes distributed over the periphery of the toroidal chamber, an annular combustion chamber, the mixing pipes being arranged to conduct the air stream from the toroidal chamber to the combustion chamber and means for introducing fuel into the air stream whereby fuel in the air stream mixes in the mixing pipes and ignites and burns in the combustion chamber to drive a turbine downstream from the combustion chamber.

2. The combustor arrangement as claimed in claim 1 including a first turbine upstream from the annular diffuser, a first combustor arranged for supplying hot gases to drive the first turbine, the conduit means being positioned to receive the hot gases exhausted from the first turbine.

3. The combustor as claimed in claim 2 wherein fuel and air ignites by self ignition at the outlet of the mixing pipes as it flows into the combustion chamber.

4. The combustor as claimed in claim 3, wherein the annular toroidal chamber has an annular secondary torus axis that extends with a large torus radius around a main torus axis, and in which annular toroidal chamber a torus outside wall with a small torus radius is formed around the secondary torus axis, and wherein the main torus axis is oriented essentially parallel to the axis of the gas turbine.

5. The combustor as claimed in claim 4, wherein the mixing pipes are substantially conical, and wherein the axes of the mixing pipes are provided outside the plane of the annular toroidal chamber and substantially vertical to the annular secondary torus axis.

6. The combustor as claimed in claim 4, wherein the mixing pipes are substantially cylindrical, and wherein the axes of the mixing pipes are provided outside the plane of the annular toroidal chamber and substantially vertical to the annular secondary torus axis.

7. The combustor as claimed in claim 4, wherein the radius of the mixing pipes is substantially equal to the small torus radius.

8. The combustor as claimed in claim 2, wherein the first combustor is an annular combustor, and wherein an outflow line is positioned between the first turbine and the diffuser, the outflow line being in the form of a hollow cylinder, and the outflow line extends parallel to the axis of the gas turbine.

9. The combustor as claimed in claim 8, wherein the annular diffuser is arranged to deflect the air stream from the outflow line from a direction parallel to the axis of the gas turbine to a direction substantially radial to the axis of the gas turbine.

10. The combustor as claimed in claim 8, wherein the diffuser is arranged to direct gas from the diffuser to flow into the toroidal chamber in a tangential manner.

11. The combustor as claimed in claim 10, wherein the diffuser is arranged to direct the gas from the diffuser against the interior wall of the toroidal chamber.

12. The combustor as claimed in claim 10, wherein the mixing pipes are located on substantially the opposite side of the toroidal chamber from the diffuser.

13. The combustor as claimed in claim 12, including fuel injection means located in the toroidal chamber and spaced from the mixing pipes.

14. The combustor as claimed in claim 12, including fuel injection means located in the mixing pipes downstream from the toroidal chamber.

15. The combustor as claimed in claim 14, wherein the fuel injection means is located in the center area of the mixing pipes.

* * * * *